United States Patent [19]

Murayama et al.

[11] Patent Number: 4,587,460

[45] Date of Patent: May 6, 1986

[54] HIGH-PRESSURE DISCHARGE LAMP OPERATING CIRCUIT

[75] Inventors: Seiichi Murayama; Makoto Yasuda, both of Kokubunji; Tsune Miyashita, Tokyo; Yoji Arai, Katsuta; Kenichi Kawasumi, Ome; Kazunori Kinoshita, Odawara, all of Japan

[73] Assignee: Hitachi, Ltd., Tokyo, Japan

[21] Appl. No.: 603,431

[22] Filed: Apr. 24, 1984

[30] Foreign Application Priority Data

Apr. 27, 1983 [JP] Japan ..... 58-72892

[51] Int. Cl.[4] ..... H05B 41/14; H05B 41/26

[52] U.S. Cl. ..... 315/174; 315/175; 315/86; 315/DIG. 7

[58] Field of Search ..... 315/174, 175, 86, DIG. 7, 315/342

[56] References Cited

U.S. PATENT DOCUMENTS

| | | | |
|---|---|---|---|
| 3,170,084 | 2/1965 | Retzer | 315/174 X |
| 3,189,790 | 6/1965 | Nuckolls | 315/174 X |
| 3,373,313 | 3/1968 | Prines et al. | 315/174 X |
| 3,875,459 | 4/1975 | Remery et al. | 315/DIG. 7 X |
| 4,362,971 | 12/1982 | Sloan, Jr. | 315/86 X |

*Primary Examiner*—David K. Moore
*Assistant Examiner*—Vincent DeLuca
*Attorney, Agent, or Firm*—Antonelli, Terry & Wands

[57] ABSTRACT

A high pressure discharge lamp in which discharge between a pair of main electrodes in an arc tube of the discharge lamp is sustained by a D.C. or high frequency current. The circuit comprises discharge mode controller for controlling the discharge such that mainly a low-frequency discharge is produced between the main electrodes at least within a predetermined time from initiation of the discharge within the arc tube, and subsequently transferred to the D.C. or high-frequency discharge.

6 Claims, 6 Drawing Figures

HIGH-PRESSURE DISCHARGE LAMP OPERATING CIRCUIT

BACKGROUND OF THE INVENTION

The present invention generally relates to an improvement of an operating circuit for a high-pressure discharge lamp, such as a metal halide lamp, high-pressure sodium lamp, high-pressure mercury lamp and others, which are operated by a D.C. or a high frequency power source. More particularly, the invention concerns a configuration of the discharge lamp operating circuit which is suited for assuring a stabilized output so that an arc spot is constantly produced at the tip of the electrode of the high-pressure discharge lamp.

The high-pressure discharge lamp, such as the metal halide lamp, the high-pressure sodium lamp, the high-pressure mercury lamp or the like, is usually operated or driven by an A.C. power source of a commercial frequency, such as 50 Hz, or 60 Hz because the use of the lamp has heretofore been limited to application for illumination. In recent years, however, the high-pressure discharge lamp tends to be used for measurements and industrial purposes. In most of these applications, it is preferred that no fluctuations be present in the light output. To this end, the discharge lamp is operated from a D.C. power source or a high-frequency power source of a frequency equal to or higher than 10 KHz in many applications. In that case, however, the arc spot on the electrode is frequently deviated from the normal position, involving adverse influence to the lamp characteristics such as intensity, stability, useful life and so on. FIGS. 1A and 1B are views for illustrating the position at which the electrode arc spot is produced in an arc tube of a metal halide lamp of 60 W taken as an example. In the figures, reference numerals 21 and 21' denote discharge plasmas, 22 denotes main electrodes made of tungsten or the like, and 23 and 23' denote the arc spots on the electrodes. FIG. 1A shows a normal discharge state in which the arc spots 23 are produced at the tips of the main electrodes 22, respectively, i.e. at the normal position. On the other hand, in the abnormal discharge state shown in FIG. 1B, the arc spots 23' are produced at the roots of the main electrodes 22, respectively, i.e. at the abnormal position. When the arc spot 23' is produced at the abnormal position, there arises a problem that the light intensity is unstable. Particularly when the arc spots 23' are produced on the roots of the electrodes 22 as shown in FIG. 1B, the sealed parts of the electrodes located at the respective ends of the arc tube are heated excessively, bringing about not only the problem of fluctuations in the light output but also a problem that the useful life of the arc tube is shortened.

As will be appreciated from the above description, the hitherto known discharge lamp operating circuit driven by a D.C. power or high-frequency power of a frequency not less than 10 KHz suffers serious shortcomings. Accordingly, there is a demand for elimination of these shortcomings.

SUMMARY OF THE INVENTION

An object of the present invention is to provide a D.C. or high-frequency operating circuit for a high-pressure discharge lamp which allows the arc spot to be constantly produced at the tip of the electrode to thereby assure stable output light intensity.

In view of the above object, there is proposed according to an aspect of the invention a high-pressure discharge lamp operating circuit for sustaining D.C. or high-frequency discharge between a pair of main electrodes in an arc tube, characterized by discharge mode controlling means provided additionally for controlling the discharge mode such that discharge is transferred to a D.C. or high-frequency discharge only after causing mainly a low-frequency discharge to take place between the main electrodes at least for a predetermined time from initiation of the discharge in the arc tube.

With the inventive arrangement mentioned above, stabilization of the output light intensity as well as increased useful life of the arc tube can be assured, whereby there can be provided a high-pressure discharge lamp operating circuit suited for applications such as measurements, industrial purposes and others.

DESCRIPTION OF THE PREFERRED EMBODIMENTS

In the first place, the principle underlying the invention will be described.

For sustaining the D.C. arc discharge, thermionic emission of electrons from a cathode is required. Consequently, in the case of discharge of the type in which heating of a cathode is effected by the discharge current, a cathode arc spot of high temperature is produced on the cathode electrode. The position of the cathode arc spot occurring immediately after the initiation of discharge is not constant as if it were accidentally determined. That is, the arc spot is not necessarily produced at the tip of the cathode nearest to the anode. However, once the cathode arc spot is produced at the tip of the cathode, the cathode arc spot tends to remain stationary at the tip of the electrode.

On the other hand, an anode arc spot is also produced on the anode at the position nearest to the cathode. This spot is likely to be produced at the tip of the anode where electrons are easy to flow in the anode.

In contrast, in the case of A.C. discharge, the cathode and the anode are changed over to each other every half-cycle. The arc spots are produced on the electrodes also in this case. In particular, when the frequency is not lower than 10 KHz, the arc spot is often produced at the root of the electrode.

However, it has been found that, as the frequency is progressively lowered, the arc spot is more likely to be produced at the tip of the electrode. Particularly at the frequency which is not higher than 1 KHz, the position of the arc spot produced even at the root of the electrode upon ignition of the arc tube is displaced without fail to the tip of the electrode within a predetermined period, to be stabilized there.

This can be explained by the fact that the electrode tip is heated during the anode half-cycle due to a great anode fall voltage, to thereby facilitate the occurrence of the electrode arc spot at the electrode tip in the succeeding cathode half-cycle.

In the light of the experimentally confirmed fact mentioned above, the present invention teaches a circuit configuration of the high-pressure discharge lamp operating circuit which is so designed that an A.C. discharge of a frequency not higher than 1 KHz, for example, may mainly take place at least within a predetermined period following the initiation of ignition of the arc tube, and D.C. or high-frequency discharge is allowed to take place only after the electrode arc spots have been transferred to the respective electrode tips. With this circuit arrangement, the problem of the prior art that the electrode arc spot is produced at the abnormal position such as the root of the electrode rather than at the normal position can be successfully solved.

Figure 1A:
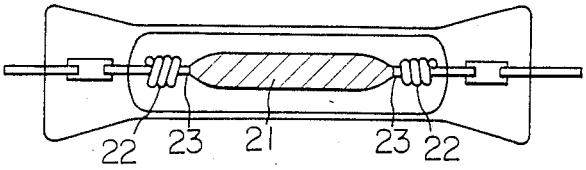
FIGS. 1A and 1B are schematic views for illustrating normal and abnormal arc spot producing states of a high-pressure discharge lamp, respectively.
Figure 1B:
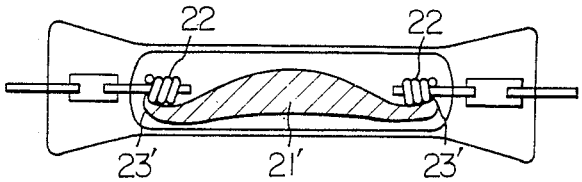
Figure 2:
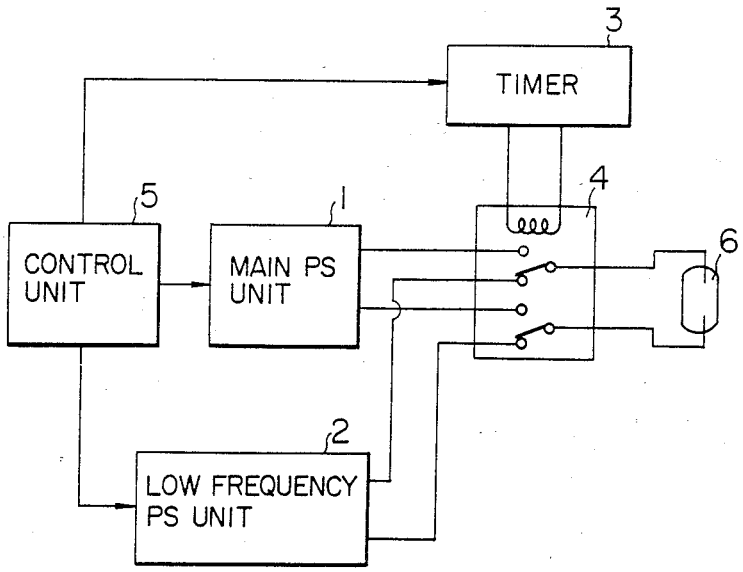
FIG. 2 is a block diagram showing a circuit arrangement of a high-pressure discharge lamp operating circuit according to an embodiment of the invention.

Next referring to FIG. 2, an exemplary embodiment of the invention will be described. In the figure, a reference numeral 1 denotes a main power source unit of D.C. or high frequency (32.5 KHz) which is usually composed of a D.C. or high-frequency power source and a current limiting circuit such as a choke coil. The current limiting circuit may preferably be realized in the form of a current regulating circuit. A numeral 2 denotes a low-frequency power source unit which may be composed of a low-frequency power source of a commercial frequency (50 Hz or 60 Hz) and a discharge ignition means such as a high voltage generator. A reference numeral 3 denotes a timer for actuating a relay 4 at predetermined times. A numeral 5 denotes a control unit or controller for controlling the main power source unit 1, the low-frequency power source unit 2 and the timer 3. The controller 5 is imparted with functions for putting into operation the main power source unit 1, the low-frequency power source unit 2 and the timer 3. A numeral 6 denotes an arc tube of a metal halide lamp.

The high-pressure discharge lamp operating circuit of the above configuration operates in the manner mentioned below.

The main power source unit 1, the low-frequency power source unit 2 and the timer 3 are put into operation by the control unit or controller 5. A high voltage is generated by the high voltage generator constituting the discharge igniting means of the low-frequency power source unit 2 to ignite the arc tube 6. The low-frequency discharge is sustained between the main electrodes for 10 to 60 seconds by the low-frequency power source unit 2. In the course of lapse of this period, the electrode arc spot is finally produced at the tip of electrode. Subsequently, the relay 4 is operated by the timer 3 to change over the low-frequency power source 2 to the main power source 1. In this manner, the electrode arc spot is produced on the electrode at the normal position without fail, to thereby assure the stable discharge. Thus, the discharge lamp whose light output can be remarkably stabilized is especially suited as a light source for the measurements.

In the case of the embodiment described above, the discharge igniting or triggering means is assumed to be incorporated in the low-frequency power source unit 2. It will however be appreciated that the discharge igniting means can be disposed in the main power source unit 1 as well. In the latter case, the main power source unit 1 is first connected to the arc tube 6 of the metal halide lamp by means of the relay 4 and switched over to the low-frequency power source unit 2. Subsequent operation is same as that described hereinbefore. It goes without saying that the relay 4 may be implemented by an electronic circuit.

Figure 3:
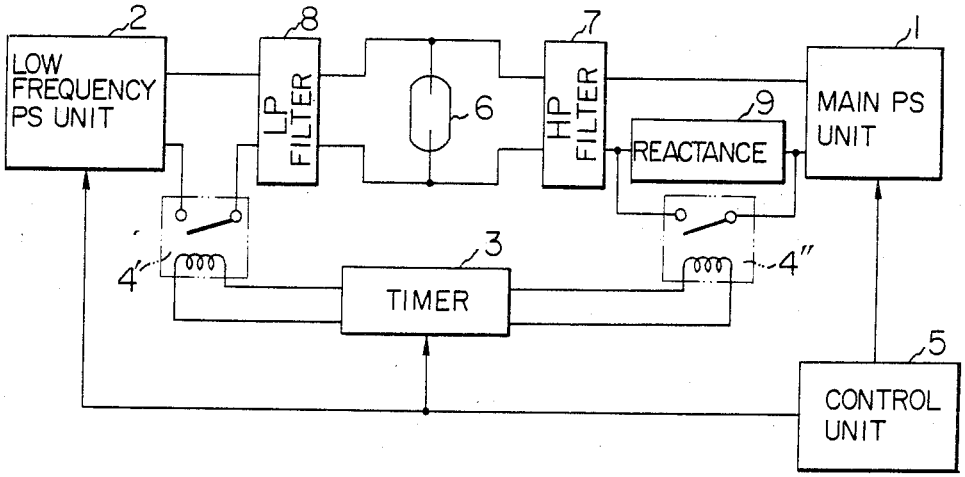
FIGS. 3 to 5 are circuit diagrams showing, respectively, circuit arrangements of the high-pressure discharge lamp operating circuit according to other embodiments of the invention.

FIG. 3 shows another embodiment of the invention in which a main power source unit of high frequency (32.5 KHz) is employed. At first, the main power source unit 1, the low-frequency power source unit 2 of 50 Hz or 60 Hz and the timer 3 are set to the operating states by the controller 5, wherein the contact of the relay 4' is closed while the contact of the relay 4'' is opened. The arc tube 6 of a metal halide lamp is ignited by the discharge ignition means such as the high voltage generator incorporated in the low-frequency power source unit 2.

Further, a reference numeral 7 denotes a high-pass (HP) filter for cutting off low frequency components and passing high frequency components, 8 denotes a low-pass (LP) filter for cutting off high frequency components while passing low frequency components, and 9 denotes a reactance for limiting a high-frequency current during a period in which the low-frequency discharge is sustained between the main electrodes. In this manner, the low-frequency discharge of 0.5 A to 3 A is mainly sustained between the main electrodes for a period of 10 to 30 seconds. During this period, high-frequency current of the order of 0.05 A to 0.5 A is usually superposed, although not necessarily. In the course of time lapse of 10 to 30 seconds, appearance of the electrode arc spot is transferred to the tip portion of the electrode. Subsequently, the contact of the relay 4' is opened with that of the relay 4'' being closed. In this way, a stable high-frequency discharge can be maintained.

Figure 4:
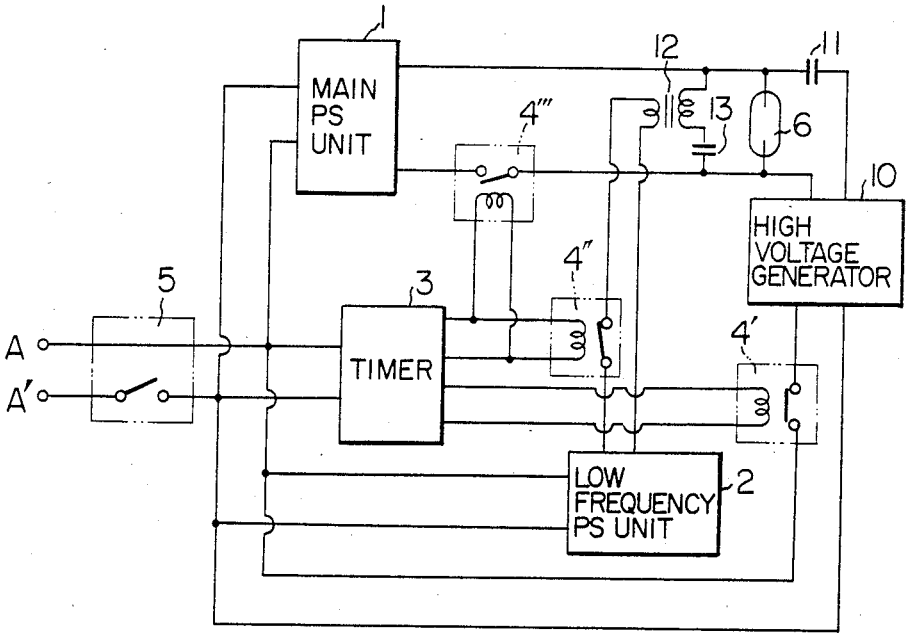

FIG. 4 shows another embodiment of the invention in which the main discharge of D.C. is utilized. By connecting input terminals A and A' to a power source of the commercial frequency with the switch of the controller 5 being turned on, the high voltage generator 10 constituting the discharge igniting or triggering means, the main power source unit 1, the low-frequency power source unit 2 and the timer 3 are put into the operating states. A gas in the arc tube 6 of the metal halide lamp is slightly ionized under a high voltage produced by the high voltage generator 10 electrically connected to the arc tube 6 through a capacitor 11, whereby discharge is ignited between the main electrodes. Subsequently, the contact of the relay 4' is opened by means of the timer 3 to stop the operation of the high voltage generator 10, to bring about the low-frequency discharge between the main electrodes under the power supply from the low-frequency power source unit 2 now electrically connected to the arc tube 6 through a coupling transformer 12 and a capacitor 13. In the course of the low frequency discharge of a duration of 10 to 30 seconds, the electrode arc spot is brought to the normal position located at the tip of electrode. Subsequently, the contact of the relay 4'' is opened by the timer 3, while the contact of a relay 4''' is closed to thereby produce the D.C. discharge under power supply from the main power supply unit 1. In this way, a light source of stable light output can be realized.

In the above description of the embodiment shown in FIG. 4, it has been assumed that the relays 4', 4'' and 4''' are operated at the predetermined time points. However, the relay 4', for example, may be operated in dependence on a detected current of the low-frequency discharge flowing through the arc tube 6 of the metal halide lamp, while the relays 4'' and 4''' may be controlled in dependence on the output of a photo-diode disposed to sense the position of the electrode arc spot so that the relays 4'' and 4''' are actuated when the arc spot is brought to the position at the tip of the electrode. In place of the detection through the photo-diode, a lamp voltage detecting mechanism may be realized by making use of a certain correlation existing between the position of the electrode arc spot and the lamp voltage.

Figure 5:
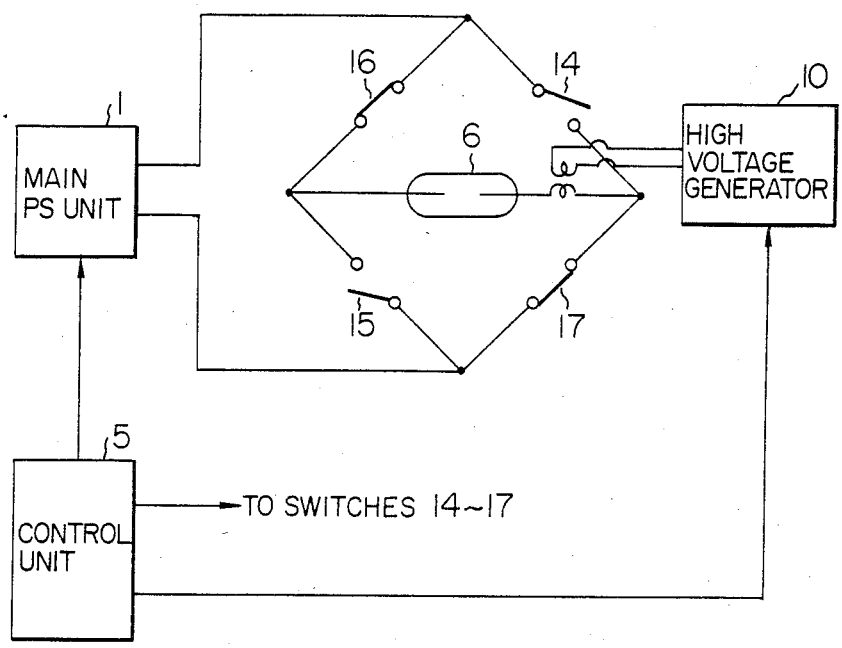

Every one of the three embodiments described above includes both the main power source unit 1 and the low-frequency power source unit 2. In contrast, FIG. 5 shows a circuit arrangement of the high-pressure discharge lamp operating circuit according to other embodiment of the invention in which the power supply is realized only by a single main power source unit 1. Referring to FIG. 5, the main power source unit 1 is constituted by at least one D.C. power source, an electronically realized current limiting circuit, voltage controlling circuit or the like for controlling the voltage or the current to be supplied to the discharge from the main power source unit 1 at a desired value. In operation, the arc tube 6 is first energized by a high voltage produced by the high voltage generator 10. For ignition of the arc tube 6, the switches 14 to 17 are controlled by the signals of the controller 5 in such a manner in which the switches 14 and 15 on one hand and the switches 16 and 17 on the other hand, for example, are alternately turned on and off at a frequency of 0.1 Hz, to apply the A.C. voltage of 0.1 Hz across the main electrodes of the arc tube 6 for thereby bringing about the A.C. discharge. In that case, the electrode arc spot will be transferred to the tip of the electrode within the succeeding period of 10 to 200 seconds to stabilize the discharge. After the stabilization of discharge within the arc tube 6, the switches 14 to 17 are then so controlled by the controller 5 that the switches 14 and 15 are turned off with the switches 16 and 17 being turned on to thereby apply the D.C. voltage to the arc tube 6 which is thus shifted to the D.C. discharge mode.

In the four embodiments of the invention described above, the low frequency discharge is extinguished at the time point when the electrode arc spot has been produced at the normal position. It should however be understood that the low frequency discharge may be continued so far as fluctuations in the light output lies in a permitted range. Further, it goes without saying that the low-frequency discharge as well as high-frequency discharge of other frequencies than the values mentioned hereinbefore may be employed.

All the embodiments of the invention have been described on the assumption that the high-pressure discharge lamp is constituted by the metal halide lamp. However, it is self-explanatory that the invention is never restricted to this lamp but can be carried out to similar advantageous effects with a lamp using a discharge in a gas of high pressure higher than a few hundreds torr.

As described heretofore, according to the present invention there is provided a high-pressure discharge lamp operating circuit which allows the electrode arc spot to be constantly located at the tip of electrode to thereby stabilize the light output or intensity. Further, according to the invention, the time required for stabilizing the intensity of output light is significantly shortened while the use life of the lamp is elongated. Thus, performances of the high-pressure discharge lamp such as the metal halide lamp and others can be improved to great advantages.

We claim:

1. A circuit for operating a high-pressure discharge lamp comprising:

discharge ignition means for igniting a discharge between a pair of main electrodes in an arc tube;

first power means for providing a low-frequency alternating electric power to said arc tube at least until an arc spot produced at each of said main electrodes by the ignition of said arc tube is located at a desired position on each of said electrodes;

second power means for providing an electric power to said arc tube after said arc spot is located at the desired position on each of said electrodes; and control means for controlling the operation of said discharge ignition means, said first power means and said second power means, so that said discharge ignition means applies a discharge voltage to said arc tube until a discharge is ignited between said pair of main electrodes, said low-frequency electric power is applied to said arc tube until said arc spot is located at said desired position on each of said electrodes, and electric power is supplied to said arc tube thereafter from said second power means for normal operation of the arc tube.

2. A high-pressure discharge lamp operating circuit according to claim 1, wherein the frequency of said first power means does not exceed 1 KHz.

3. A high-pressure discharge lamp operating circuit according to claim 1, wherein said second power means is a DC power source.

4. A high-pressure discharge lamp operating circuit according to claim 1, wherein said second power means is a high-frequency power source having a frequency not lower than 10 KHz.

5. A high-pressure discharge lamp operating circuit according to claim 1, wherein said first power means is an AC power source of a commercial frequency.

6. A high-pressure discharge lamp operating circuit according to claim 1, wherein said first power means comprises means for providing electric power to said arc tube at a frequency which will cause an arc spot to be produced at the tip of each of said main electrodes.

* * * * *